US006598997B2

(12) United States Patent
Shyu

(10) Patent No.: US 6,598,997 B2
(45) Date of Patent: Jul. 29, 2003

(54) LIGHT ASSEMBLY HAVING CHANGEABLE COLORS

(76) Inventor: Shing Jy Shyu, P.O. Box 10-69, Chong Ho, Taipei (TW), 235

( * ) Notice: Subject to any disclaimer, the term of this patent is extended or adjusted under 35 U.S.C. 154(b) by 0 days.

(21) Appl. No.: 10/029,140

(22) Filed: Dec. 20, 2001

(65) Prior Publication Data

US 2003/0117804 A1 Jun. 26, 2003

(51) Int. Cl.[7] ..... F21V 17/02; F21V 9/10

(52) U.S. Cl. ..... 362/280; 362/216; 362/278; 362/293; 362/320; 362/323

(58) Field of Search ..... 362/216, 278, 362/280–284, 293, 320, 322–324; 40/438

(56) References Cited

U.S. PATENT DOCUMENTS 1,515,444 A * 11/1924 Shepard ..... 40/438
3,083,293 A * 3/1963 Fandrey ..... 362/293
3,208,174 A * 9/1965 Wrenshall ..... 362/216
3,755,664 A * 8/1973 Reiback ..... 362/280

* cited by examiner

*Primary Examiner*—Alan Cariaso

(57) ABSTRACT

A light assembly includes a light device and a color member disposed in a housing. A driving device, such as one or more motors are disposed in the housing, and engaged with the color member for moving the color member relative to the light device to generate different colors when the color member is moved relative to the light device. The light device includes one or more peripheral light tubes, and a casing is secured in the housing. The color member is disposed around the casing and disposed between the casing and the peripheral light tubes of the light device.

1 Claim, 8 Drawing Sheets

LIGHT ASSEMBLY HAVING CHANGEABLE COLORS

BACKGROUND OF THE INVENTION

1. Field of the Invention

The present invention relates to a light assembly, and more particularly to a light assembly having changeable colors.

2. Description of the Prior Art

Typical light devices comprise a light tube or a light bulb or a light device secured in a hood or the like. The light may not be changed to different colors.

The present invention has arisen to mitigate and/or obviate the afore-described disadvantages of the conventional light devices.

SUMMARY OF THE INVENTION

The primary objective of the present invention is to provide a light assembly including a color device for changing to different colors.

In accordance with one aspect of the invention, there is provided a light assembly comprising a housing, a light device disposed in the housing, a color member disposed in the housing, and means for moving the color member relative to the light device to generate different colors when the color member is moved relative to the light device. The light assembly may be directly attached to the ceiling or may be secured to the ceiling fan or the like.

The light device includes at least one peripheral light tube secured in the housing. The housing includes a plurality of posts secured thereto, the color member is engaged around the posts.

The posts are arranged in one or more circles, the color member is an endless belt member engaged around the posts.

The moving means includes one or more motors each having a spindle engaged with the color member to move the color member relative to the light device, and for allowing the light generated by the light device to shine onto the color member and to generate different or changing light colors when the color member is moved relative to the housing and the light device.

A casing is further provided and secured in the housing and disposed in the light device and the color a member. The color member is disposed between the light device and the casing.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 5:
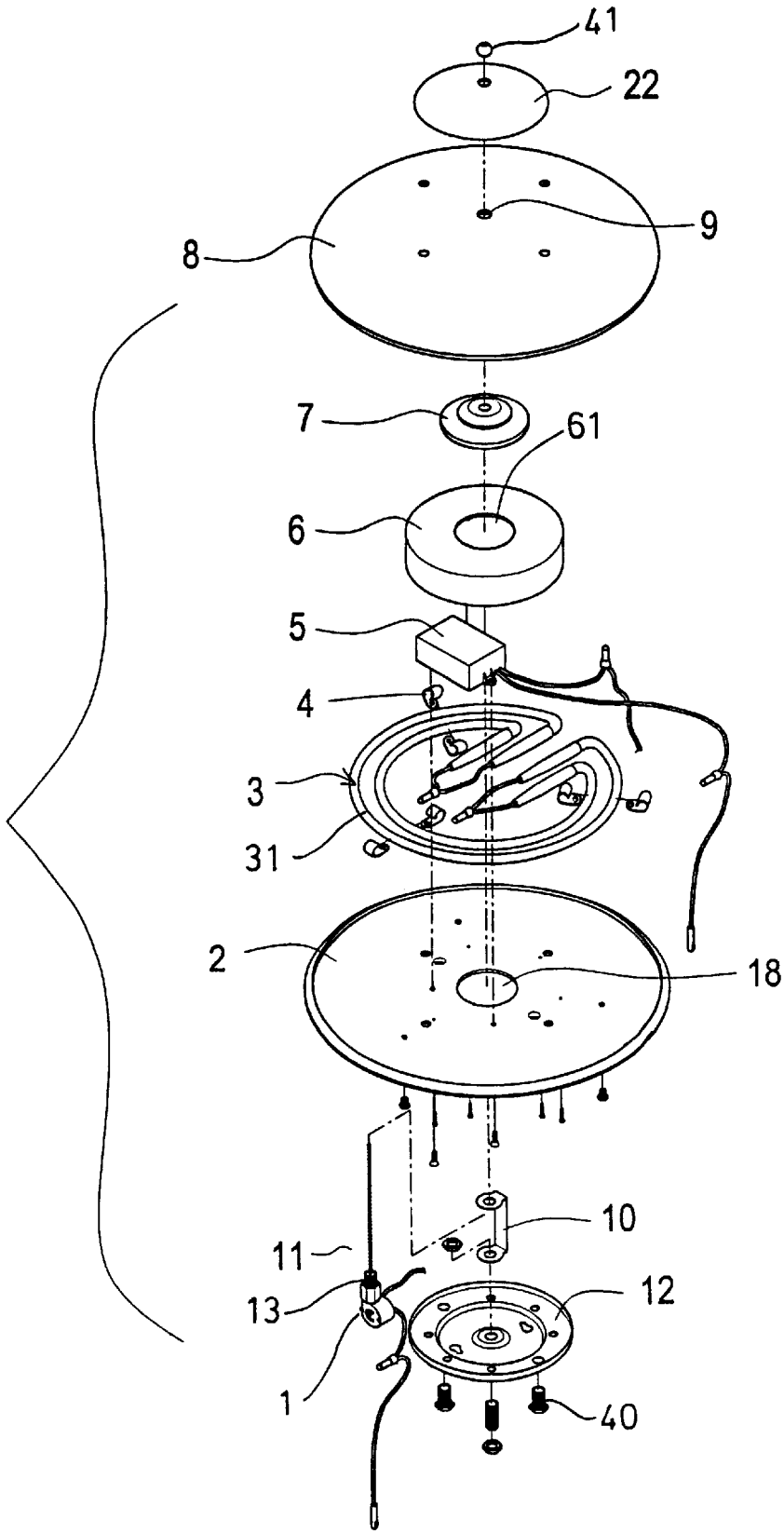
FIG. 5 is a further partial exploded view of the light assembly, in which the light assembly has been disposed up-side-down.
Figure 6:
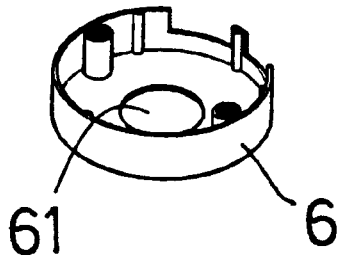
FIG. 6 is a perspective view of a casing of the light assembly.

Referring to the drawings, and initially to FIGS. 1–6, a light assembly in accordance with the present invention comprises a housing 2 including a curved or concave structure having an orifice 18 formed therein (FIG. 5). A cap 12 is secured on top of the housing 2 with fasteners 40, for example. A shank 10 has one end engaged through the orifice 18 of the housing 2 and secured to the cap 12. A switch 1 is secured to the shank 10, and includes a bolt or a fastener 13 extended outward of the shank 10, and includes a pulling chain 11 extended downward or outward of the fastener 13 and the shank 10.

Figure 7:
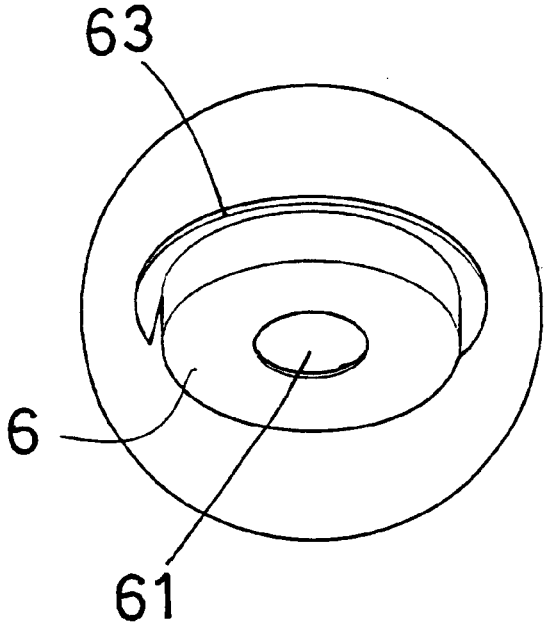
FIG. 7 is a bottom perspective view illustrating the other embodiment of the casing of the light assembly.
Figure 8:
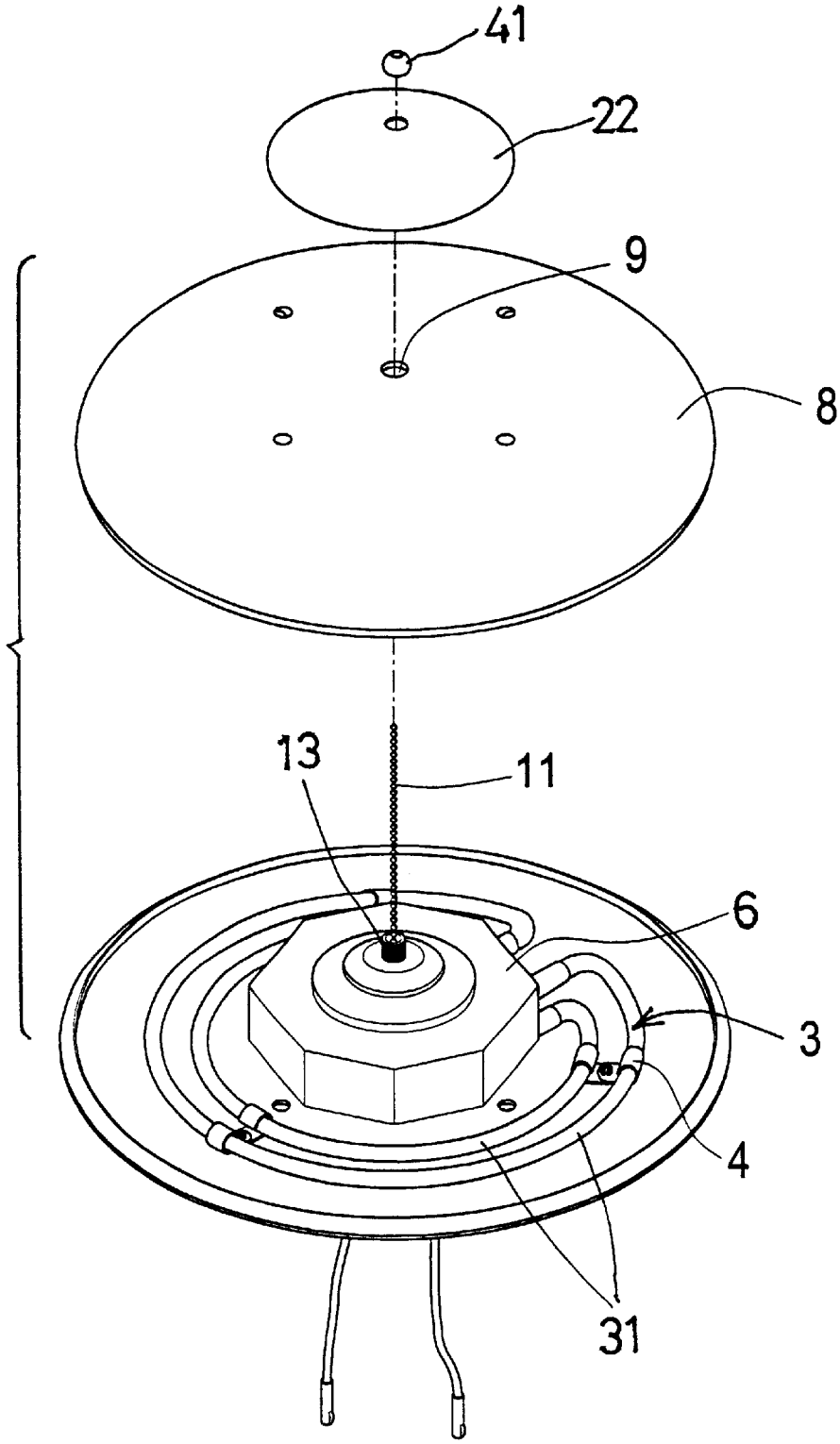
FIG. 8 is a partial exploded view similar to FIG. 4, illustrating the a further embodiment of the casing of the light assembly, in which the light assembly has been disposed up-side-down.

A light tube or a light bulb or a light device 3 is secured in or to the bottom of the housing 2 with one or more brackets 4, and includes one or more peripheral light tubes 31. A control box 5 is secured in the bottom portion of the housing 2 with a casing 6 which is engaged in the peripheral light tubes 31 of the light device 3 and which has an opening 61 formed therein (FIGS. 5, 6) for receiving the fastener 13 and the chain 11. The casing 6 may includes a peripheral flange 63 (FIG. 7) for engaging with the housing 2; or may include different shapes, such as a polygonal shape as shown in FIG. 8. A lid 7 may be threaded to the fastener 13 and engaged with the casing 6 for securing the casing 6 to the housing 2.

Figure 1:
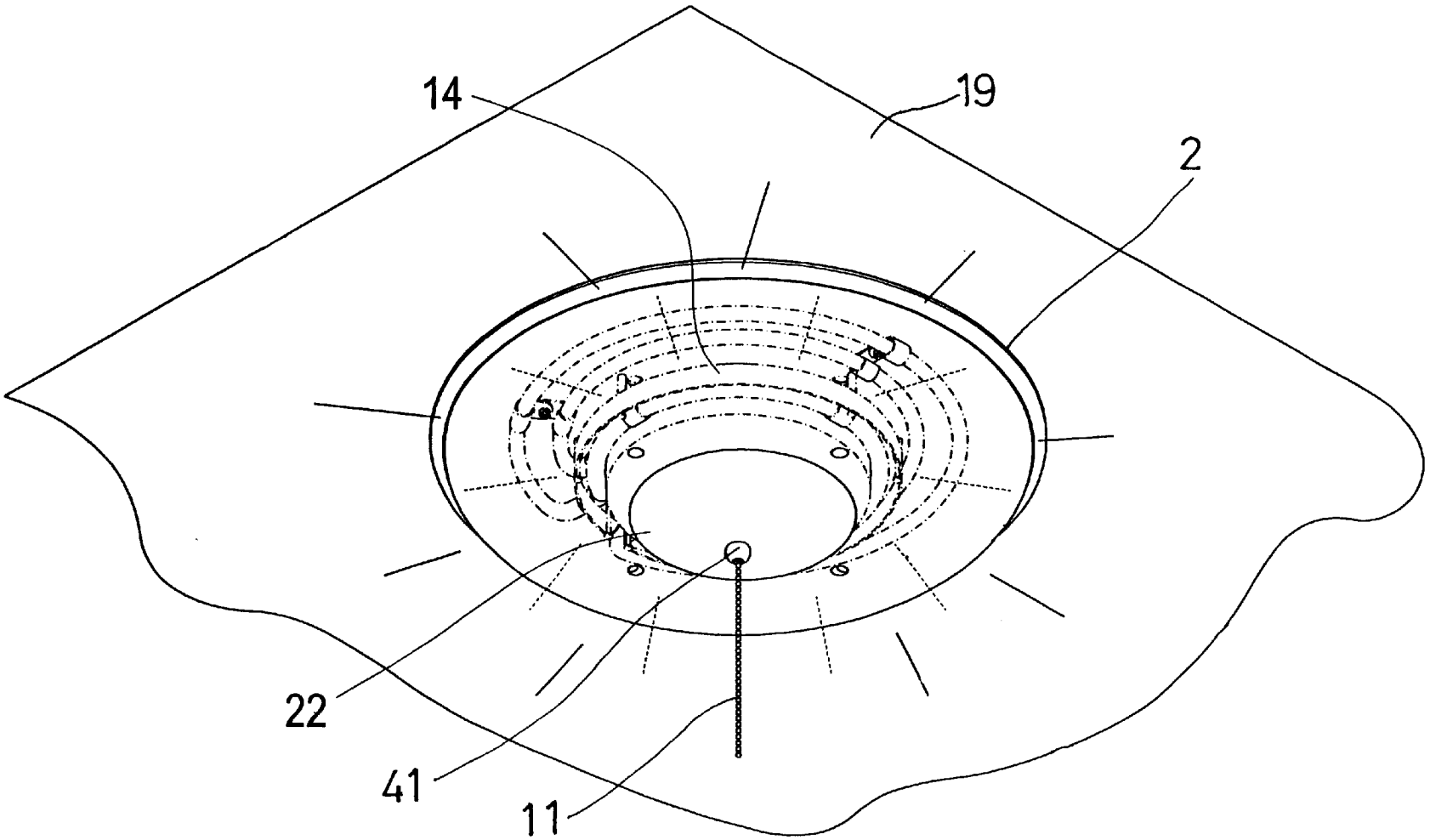
FIG. 1 is a bottom perspective view of a light assembly in accordance with the present invention.
Figure 9:
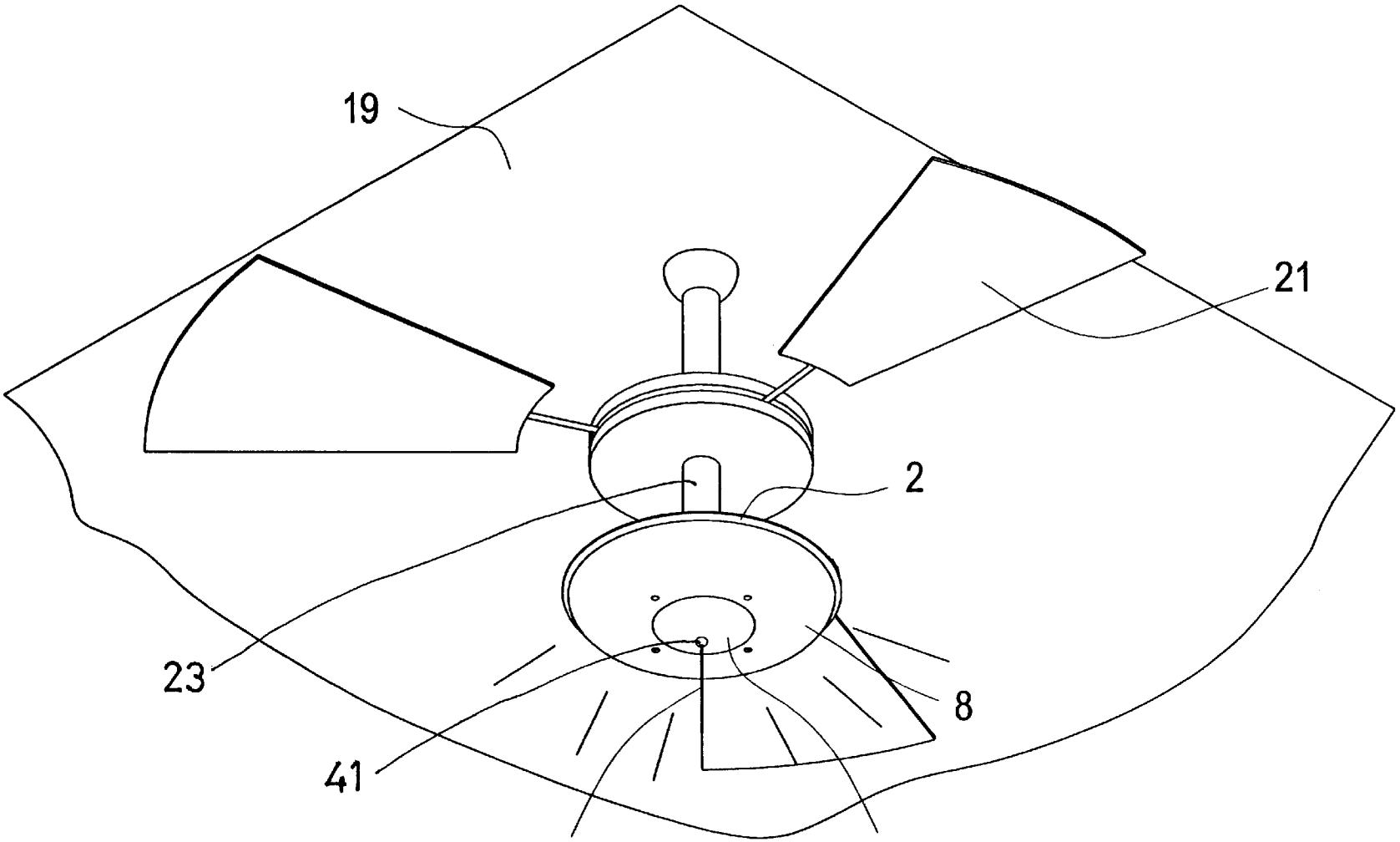
FIG. 9 is a perspective view illustrating the operation of the light assembly.

A hood 8, such as a transparent or semi-transparent hood 8 is engaged onto the bottom of the housing 2 for shielding or enclosing the casing 6 and the light device 3 within the housing 2 and includes an aperture 9 formed therein for receiving the fastener 13 and the chain 11. A cover 22 is further attached or secured to the bottom of the hood 8 for decorative purposes, for example. A lock nut 41 may be threaded to the fastener 13 and engaged with the cover 22 for securing the cover 22 and the hood 8 to the housing 2. The housing 2 may be secured to a down rod 23 of a fan device 21, as shown in FIG. 9, or may be directly secured to the ceiling as shown in FIG. 1.

Referring again to FIGS. 2 and 3, a number of rods or posts 15 are secured to the housing 2, and are arranged in substantially two circles, and are disposed between the casing 6 and the light device 3. A color member 14, such as an endless color strap or belt member 14, or such as a reflective color member 14 is engaged around the posts 15 and movable around the posts 15. One or more motors 16 are secured to the housing 2 and each includes a spindle 66 engaged with the endless color member 14 with such as pads or gaskets, for driving or moving the color member 14 around the posts 15. The motors 16 and the light device 3 and/or the fan device 21 may be controlled with the control box 5 by pulling the pulling chain 11.

Figure 2:
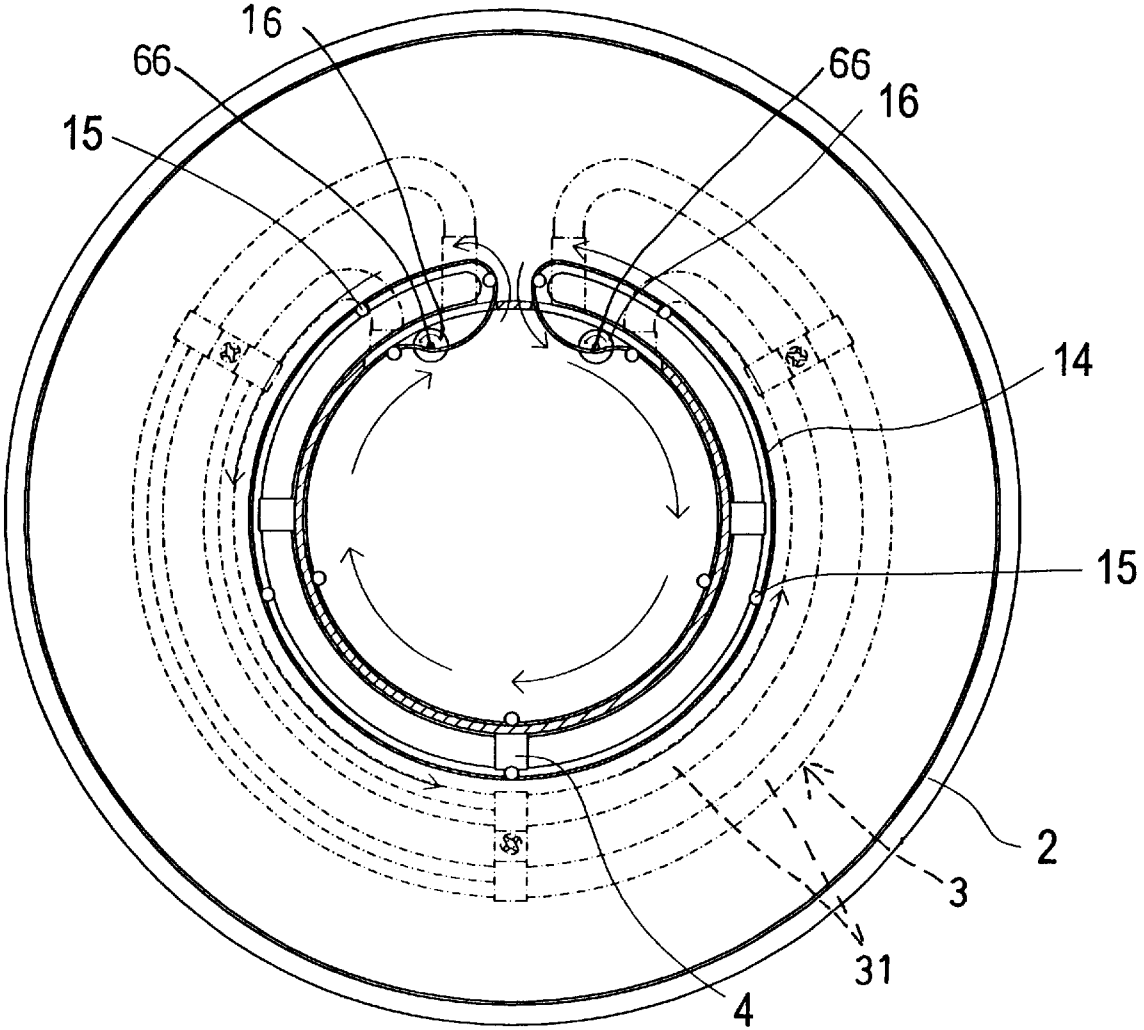
FIG. 2 is a bottom plan view of the light assembly, in which the hood of the light assembly has been removed for illustrating the inner structure of the light assembly.
Figure 3:
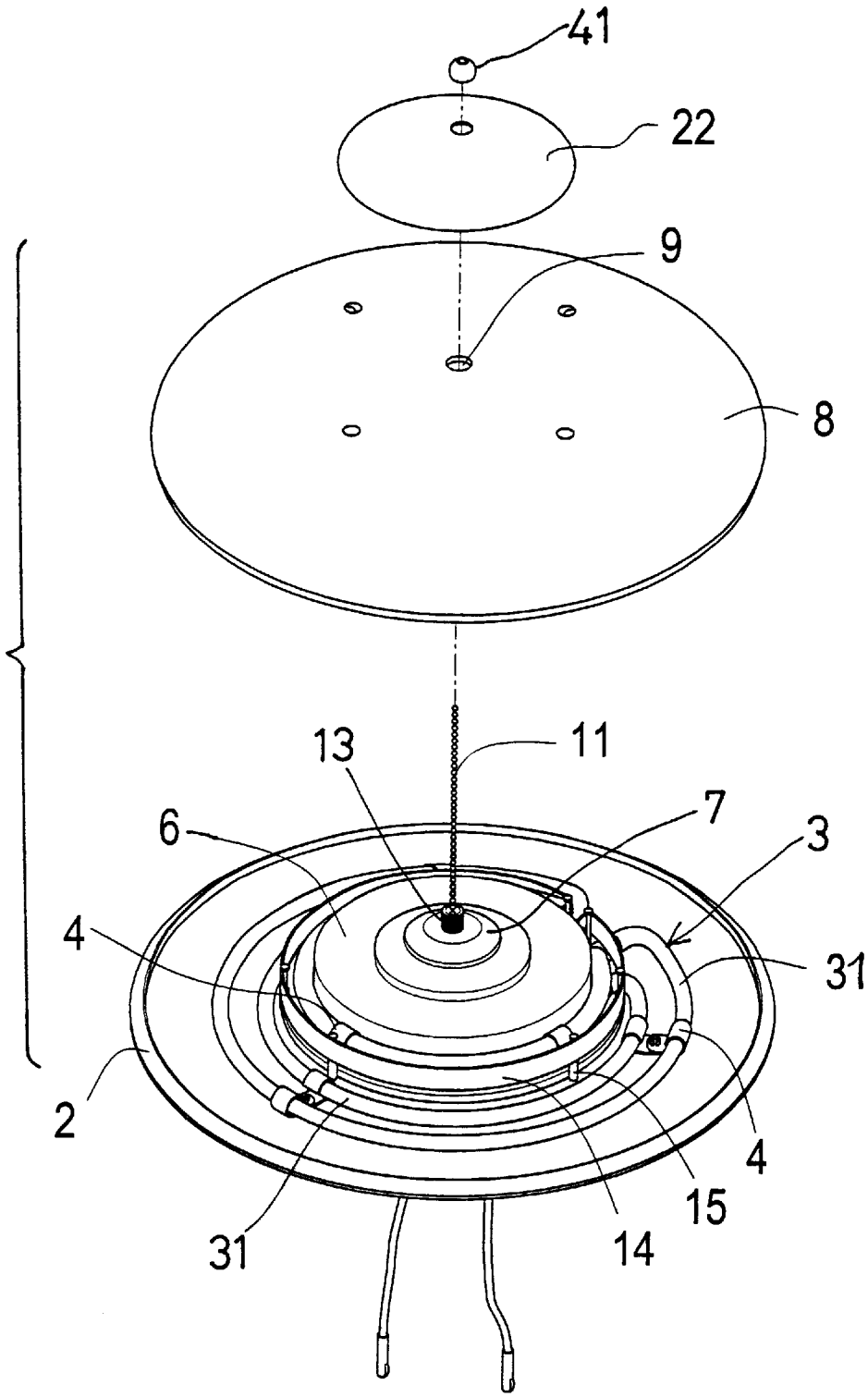
FIG. 3 is a partial exploded view of the light assembly, in which the light assembly has been disposed up-side-down and the hood of the light assembly has been separated from the light housing body for illustrating the inner structure.of the light assembly.
Figure 4:
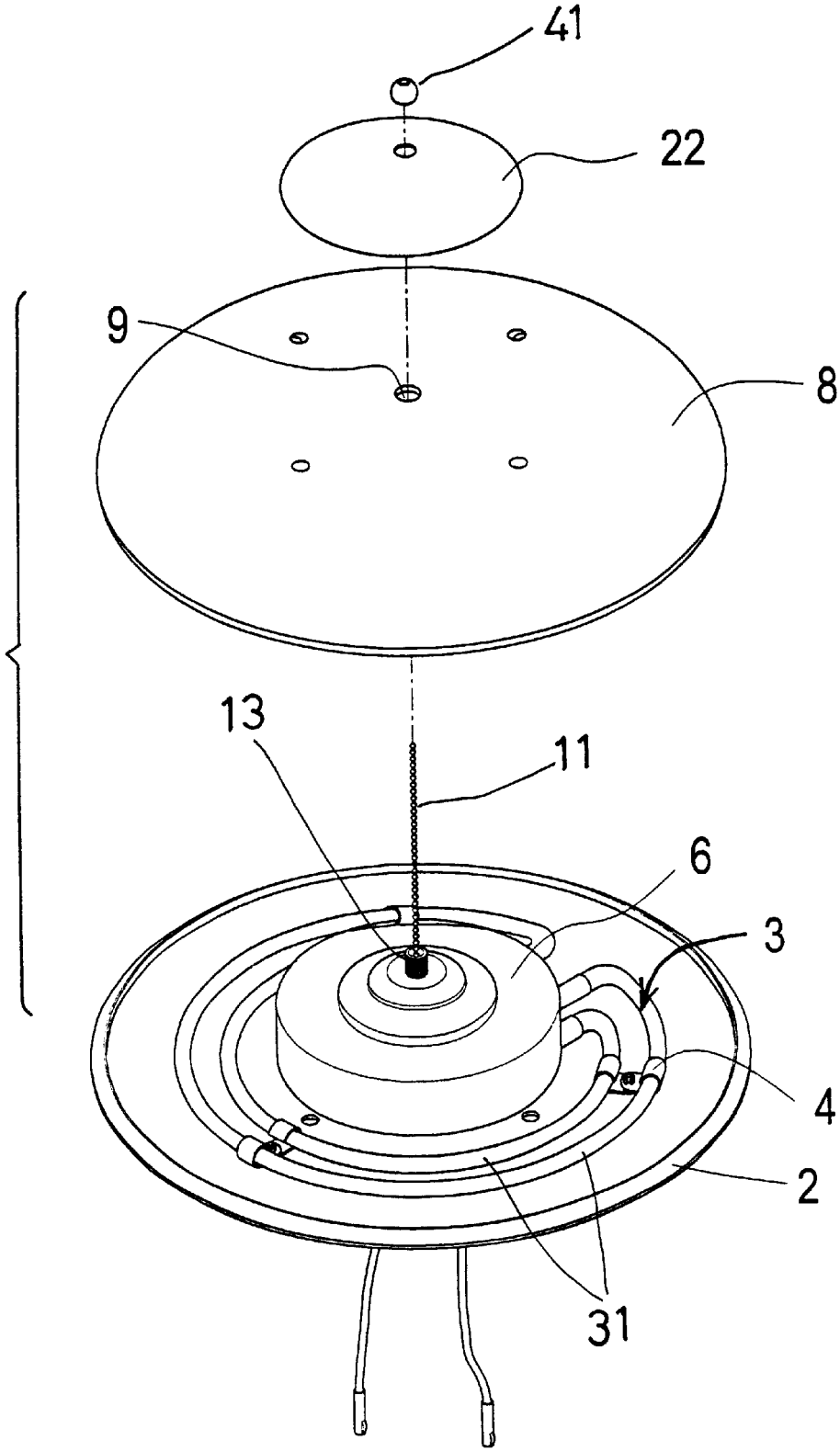
FIG. 4 is a partial exploded view of the light assembly, similar to FIG. 3, in which the light assembly has been disposed up-side-down and the color device has been removed and the hood of the light assembly has been separated from the light housing body for illustrating the inner structure of the light assembly.

In operation, as shown in FIG. 2, the endless color member 14 may be driven or moved around the posts or moved relative to the housing 2 and the light device 3 by the motors 16. The light generated by the light device 3 may shine onto the color member 14 and may generate different or changing light colors when the color member 14 is moved relative to the housing 2 and the light device 3.

Accordingly, the light assembly in accordance with the present invention includes a color device for changing to different colors.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A light assembly comprising:

a housing, a light device disposed in said housing, and including at least one peripheral light tube secured in said housing, a casing disposed in said housing, and disposed in said at least one peripheral light tube, a plurality of posts secured in said housing and arranged in a first circle and arranged between said casing and said at least one peripheral light tube, and a plurality of posts arranged in a second circle and arranged around said at least one peripheral light tube, an endless color belt member engaged with said posts, and arranged around said at least one peripheral light tube and around said casing, and at least one motor including a spindle engaged with said color belt member to move said color belt member around said posts and said light device and said casing.

* * * * *